US005627376A

United States Patent [19]

Jaisinghani et al.

[11] Patent Number: 5,627,376

[45] Date of Patent: May 6, 1997

[54] WIRE CORONA CHARGING APPARATUS

[75] Inventors: Rajan A. Jaisinghani, Midlothian; Tim G. Christensen, Chester, both of Va.

[73] Assignee: SamSung Electronics Co., Ltd., Kyungki-do, Rep. of Korea

[21] Appl. No.: 525,163

[22] Filed: Sep. 8, 1995

[51] Int. Cl.[6] ..... H01T 19/04

[52] U.S. Cl. ..... 250/325; 250/324

[58] Field of Search ..... 250/324, 325, 250/326; 361/225

[56] References Cited

U.S. PATENT DOCUMENTS

| | | | |
|---|---|---|---|
| 3,562,585 | 2/1971 | Gourdine | 361/4 |
| 3,609,484 | 9/1971 | Sakamaki et al. | 250/326 |
| 3,619,242 | 11/1971 | Ogawa et al. . | |
| 3,980,929 | 9/1976 | Bresnick | 361/57 |
| 4,002,907 | 1/1977 | Kalwar . | |
| 4,131,691 | 12/1978 | Morley et al. . | |
| 4,215,682 | 8/1980 | Kubik et al. . | |
| 4,551,784 | 11/1985 | DiNatale et al. | 250/324 |
| 4,606,930 | 8/1986 | Ueno et al. . | |
| 4,714,658 | 12/1987 | Kadash et al. . | |
| 4,772,788 | 9/1988 | Tsutsui et al. . | |
| 4,836,901 | 6/1989 | Manabe et al. . | |
| 5,108,780 | 4/1992 | Pitt et al. . | |
| 5,110,620 | 5/1992 | Tani et al. . | |
| 5,112,690 | 5/1992 | Cohen et al. . | |
| 5,135,724 | 8/1992 | Dinter et al. . | |
| 5,175,666 | 12/1992 | Saito | 250/324 |
| 5,194,291 | 3/1993 | D'Aoust et al. . | |
| 5,236,536 | 8/1993 | Brehm et al. . | |
| 5,264,989 | 11/1993 | Bauer | 361/225 |
| 5,332,897 | 7/1994 | Stobbe et al. | 250/324 |

*Primary Examiner*—Bruce C. Anderson
*Attorney, Agent, or Firm*—Robert E. Bushnell, Esq.

[57] ABSTRACT

An improved wire corona charging apparatus and processes for treating webs and films, to improve surface wettability characteristics and other surface properties, and to create permanently charged electrets. Corona produced by wires results in more evenly distributed ion flux under a high level of control, than possible with commonly used bar chargers. Wire chargers are not used in applications that involve webs and films of large width, since at these widths wires can slacken and break, resulting in possible electric shorting that can be a safety hazard in most non-batch processes. The embodiments disclosed overcome these reliability and safety issues.

27 Claims, 11 Drawing Sheets

WIRE CORONA CHARGING APPARATUS

BACKGROUND OF THE INVENTION

1. Field of the Invention

The present invention relates to treatment of webs and films of fibrous material more particularly, to wire corona charging apparatus and processes.

2. Description of Background Art

Corona processes are used for surface treatment of fiber webs and films. Although surface treatment can have many other objectives, the most important or common objectives are to increase wettability for printing, to increase absorptive characteristics (see, for example, Dinter et al., U.S. Pat. No. 5,135,724), and to produce permanently charged materials that are typically referred to as electrets (see, for example, Wadsworth and Hersh, U.S. Pat. No. 4,375,718). Such processes involve apparatus for causing corona discharge. Corona producing apparatus that can be used in these surface treatment processes are commonly referred to as "ionizers", "corona treaters" or "corona devices" or "chargers".

Thin wires produce a highly controlled and well distributed ion flux, when compared to more commonly used corona devices such as charge bars, rods, and needle points, principally because of the small diameter of the wires. Corona streamers produced from smaller diameter wires are more uniform across the treatment surface than those produced by using larger diameter rods or sharp edges or needle points (White, *Industrial Electrostatic Precipitation*, Addison-Wesley Publishing Company, Inc. 1963). Additionally, the amount of ozone, a pollutant, produced by small wire corona chargers is lower than the amount of ozone produced by larger diameter wires, rods, etc. (Whit, 1963). Another advantage of wire corona chargers is that due to the highly distributed ion flux, (i.e., uniform streamers) there is a lower possibility of producing violent, high density sparks that can cause pitting in counter potential rollers (see, for example, Schuster U.S. Pat. No. 4,281,247) that are coated with a dielectric layer (typically a ceramic coating). Corona produced from other devices, such as charge bars, rods, or sharp points results in such sparks and pitting under many conditions. Such rollers are expensive, and thus pitting can substantially increase operating cost when such corona charge bars are used.

Although wires are commonly suggested as options for use in corona charging equipment, we have found that wires are seldom, if at all, used in corona devices for treatment of webs or films that are over 24–30 inches wide because wires require high axial tension when strung over wide widths, in order to prevent slack from occurring in the middle of the wires. In contrast, bars, rods and sharp points do not require axial tension for mounting in wide ionizers. By way of explanation, rods and bars, regardless of their specific cross-sectional shape (with that cross-sectional shape taken within a plane dividing the rod or bar and defining an orthogonal angle with the longitudinal axis of the rod or bar) are elongate elements having sufficiently large dimensions within that plane that the linear measurement of deflection of the centroid of a bar or rod over a span where the unloaded bar or rod is simply supported only at its opposite ends is significantly less than the greatest value of a cross-sectional dimension of the bar or rod taken along a line parallel to the path of the centroid during the deflection. In contradistinction, although a wire is also an elongate element, the centroid if an unloaded wire simply supported only at its opposite ends will freely trace a path during deflection of the wire that is many times greater than the greatest cross-sectional dimension of the wire taken along a line parallel to that path, even while the opposite ends of the wire are held under tension. Consequently, to restrict the deflection of a centroid of a wire to a value that is comparable to that of a bar or rod of the same length, it is necessary to hold the opposite ends of the wire with such a high degree of tension that substantial risk exists that the wire will break. Wires used in wide corona chargers can therefore easily break and cause safety hazards in these surface treatment processes, which are typically continuous processes running at high speeds. We have also found that wires can get snagged with the film or roll moving at high speed, thus causing safety problems, and damage to process components. In order to alleviate this breakage problem, tungsten wires have been suggested, chiefly due to the high tensile strength of tungsten. Typically, tungsten wires with 0.2–1 millimeter diameters are preferred for corona charging processes (cf. Nakao, U.S. Pat No. 4,582,815). Many web and film processes however involve web or film widths between 50–120 inches. Over such lengths, even tungsten wires of these small diameters can break while under tension.

We have noticed that another reason for the lack of use of wires in contemporary wide corona chargers is that over time, the wire can relax and, when the wire lengths are long, the slack in the middle part of the wire can produce field strength variations and, in some cases, may even become tangled with the web or film.

Primarily due to the safety issues due to breakage of wires, typically charge bars (as is suggested by Wadswo and Hersh, U.S. Pat. Nos. 4,375,718 and by Dinter et al., 5,135,724) are preferred in such applications, even though corona produced by thin wires have distinct advantages that are not available with charge bars. Additionally, charge bars are preferred in contemporary chargers because many charge bar designs enable the introduction of gases or aerosols (as, for example, Dinter et at., 5,135,724 and Kubik and Davis, 4,215,682) into the corona- these gases or aerosols are thought to enable better or specific surface treatment of the fibrous materials, often through surface chemical reactions induced by corona treatment. Currently, there are no wire based chargers on the market that facilitate the introduction of aerosols and or gases into the corona region.

SUMMARY OF THE INVENTION

It is therefore one object of the present invention to provide an improved wire charger for corona production in the treatment of fiber webs and films.

It is another object to provide a wire charger for corona production in the treatment of fiber webs and films facilitating automatic shutdown of the process and interruption of the application of high voltage in case of wire breakage.

It is still another object to enable the use of shorter wires, with higher resistance to breakage, in a wide corona treater, without creating zones of the fibrous material that are not corona treated during a process.

It is yet another object to provide a process and a corona wire charger that enables the introduction of treatment aerosols and gases into the corona produced by the thin wires of the wire charger.

It is still yet another object to enable increasing the corona current density in a uniform manner, by avoiding the use of liquid aerosols in the corona producing region.

It is a further object to provide a process and a corona wire charger achieving an enhanced corona density and uniformity in distribution within the corona producing region by pumping high humidity ambient air into the corona producing region.

It is a still further object to provide a process and a corona wire charger achieving an increased level of surface treatment and induced corona current production.

It is a yet further object to provide a corona charger that minimizes the risk of pitting of dielectric or other coatings on the counter potential rolls used in web and film treatment processes.

It is also an object to provide a process and a corona wire charger that enables production of a uniform electric field between the wires and the counter potential rolls, and thus provide for uniformly distributed corona treatment.

These and other objects may be achieved with a wire ionizer constructed according to the principles of the present invention with a high dielectric strength framework having a channel for holding a plurality of ionizing wires and other components. The ionizing wires are connected by means of springs, on one end to ceramic insulators attached to levers connected to the framework, and to a power distribution bar attached to ceramic insulators which are in turn attached, in the case of shorter ionizer widths, to the other end of the framework, or, in the case of significantly larger ionizer widths, to a thin mid section of framework. Spring loaded electric switches are positioned in contact with one arm of the levers so that upon breakage of one of the wires, the corresponding lever does not exert any pressure on the contact arm of the switches, thus opening the electric circuit across the switch and thereby stopping the process. A shield insulates a desired portion of the length of the wires and thus adjusts the width of the corona field so as to adapt the wire ionizer for different widths of web and film. A channel accommodates passage of compressed gas or air or aerosol into the ionizing zone and a netting or highly perforated dielectric material is attached to the front face of the ionizer frame to trap the ionizing wires inside the channel within the frame, in case of wire breakage. A high voltage power supply is connected to the power distribution bar, thus enabling ionization, when the wire ionizer is in the near vicinity of the counter potential web or film processing roller. Electrical power for the entire web or film drive is routed through a controller for the process drive power relay, which is controlled by power supplied via the switches in a break detecting lever switch bank. These switches may be connected in series to the electric power. As long as current flows through the switches (i.e., while all of the ionizing wires are unbroken and intact), the process drive power relay is enabled. Should one of the ionizing wires break, the power through the switches is disrupted and the process drive power relay is opened, thus stopping the process.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
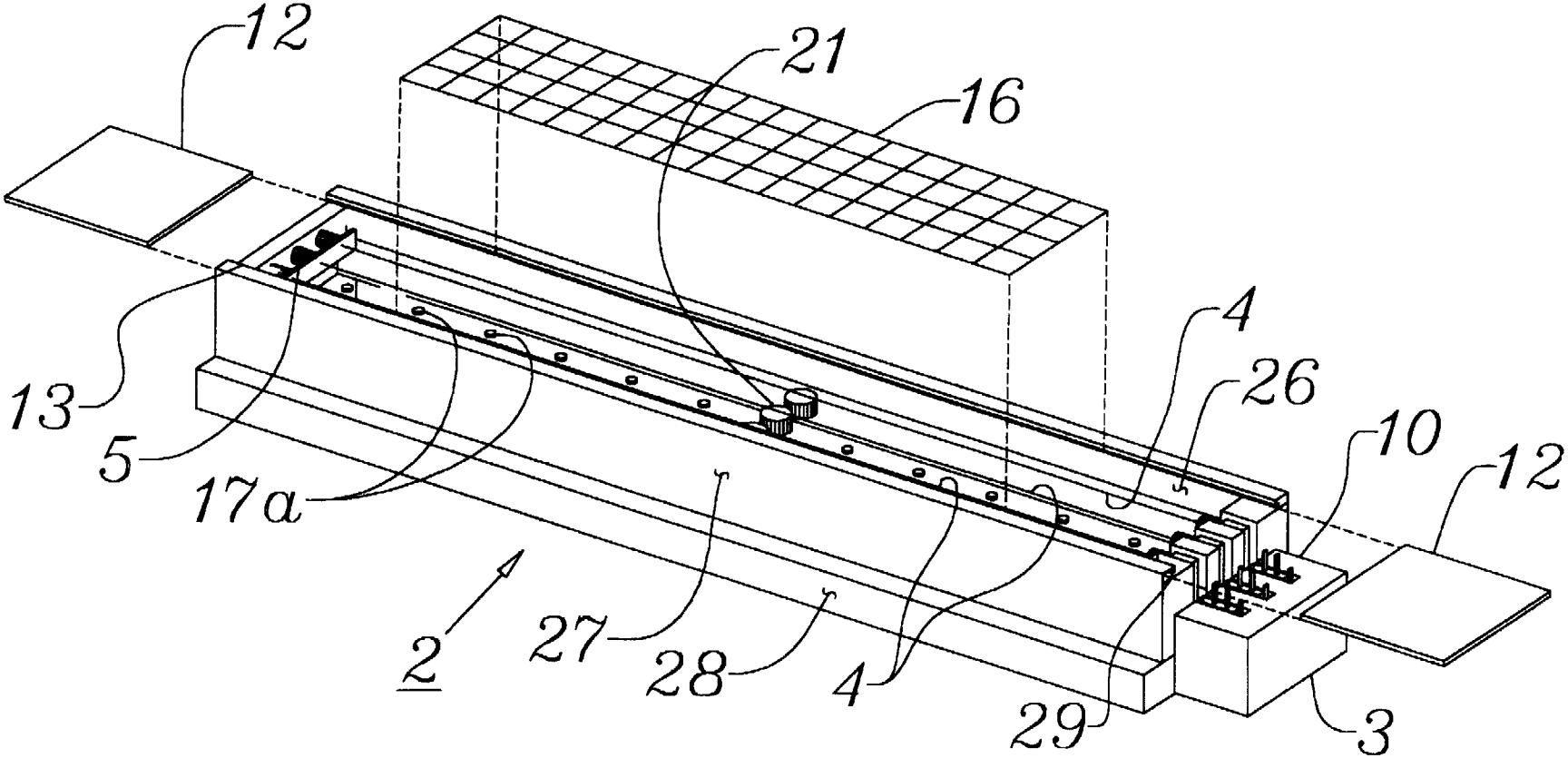
FIG. 1 is an exploded three dimensional perspective view of one embodiment of a wire ionizer with continuous wires strung across the face of the device.

The following description is of the best mode presently contemplated for carrying out the invention. This description is not to be taken in a limiting sense, but is made merely for the purpose of describing the general principles of the invention. The scope of the invention should be determined with reference to the claims.

Referring now to the drawings, the wire ionizer or corona discharge device for application in continuous treatment of film and web, is generally indicated by reference numeral 1. Referring to FIGS. 1, 2, 3, 4 and 5, the primary components of wire ionizer 1 are the channel frame 2, the wire tension lever 8 and switch block assembly 3, plurality of ionizing wires 4 and the high voltage (hereinafter referred to as HV) bus assembly 5.

Figure 3:
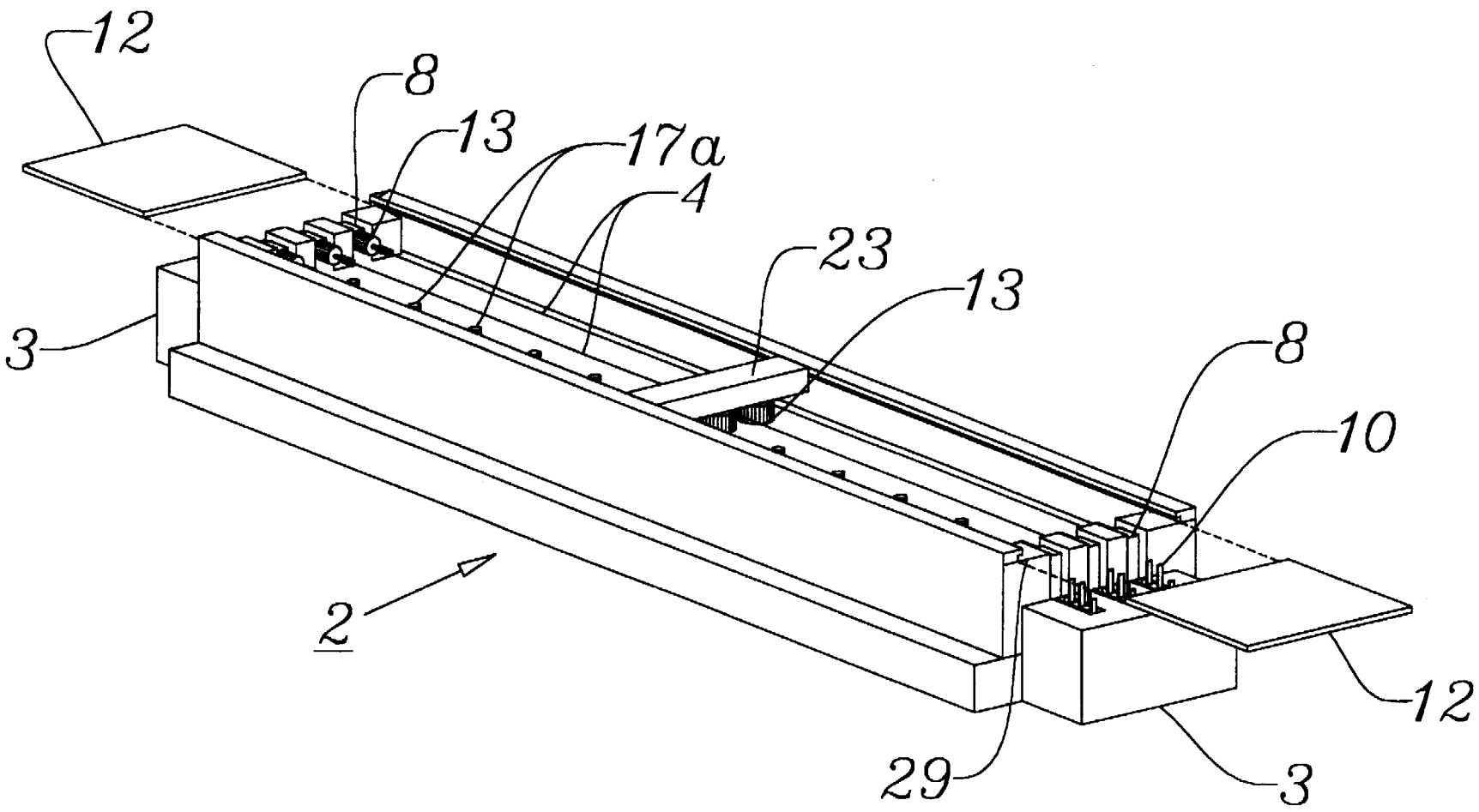
FIG. 3 is a three dimensional view of an embodiment of a wire ionizer with split wires that cover the entire face of the device.
Figure 4:
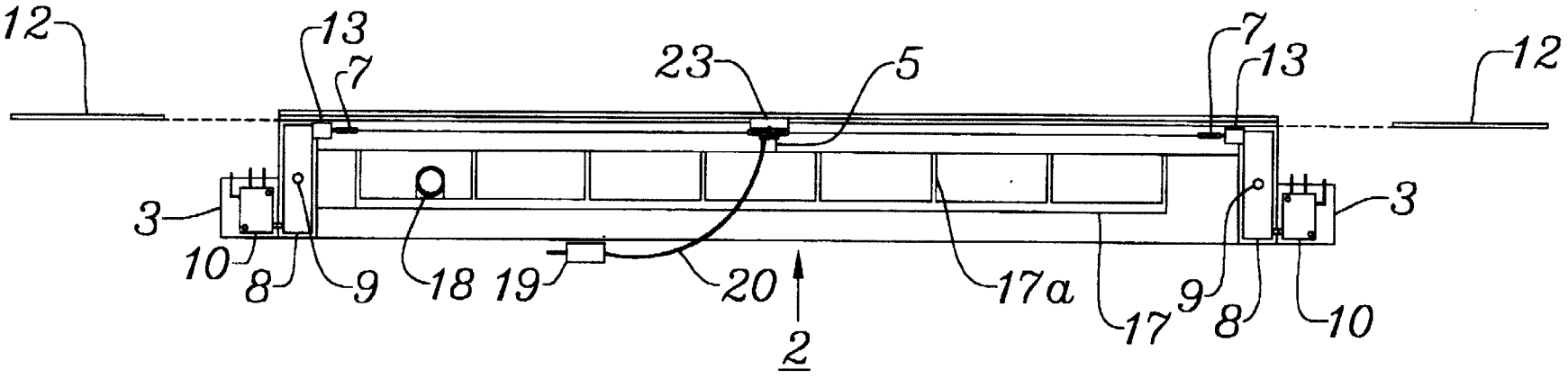
FIG. 4 is an elevational cross sectional view of the wire ionizer with split wires strung across the face of the device.
Figure 5:
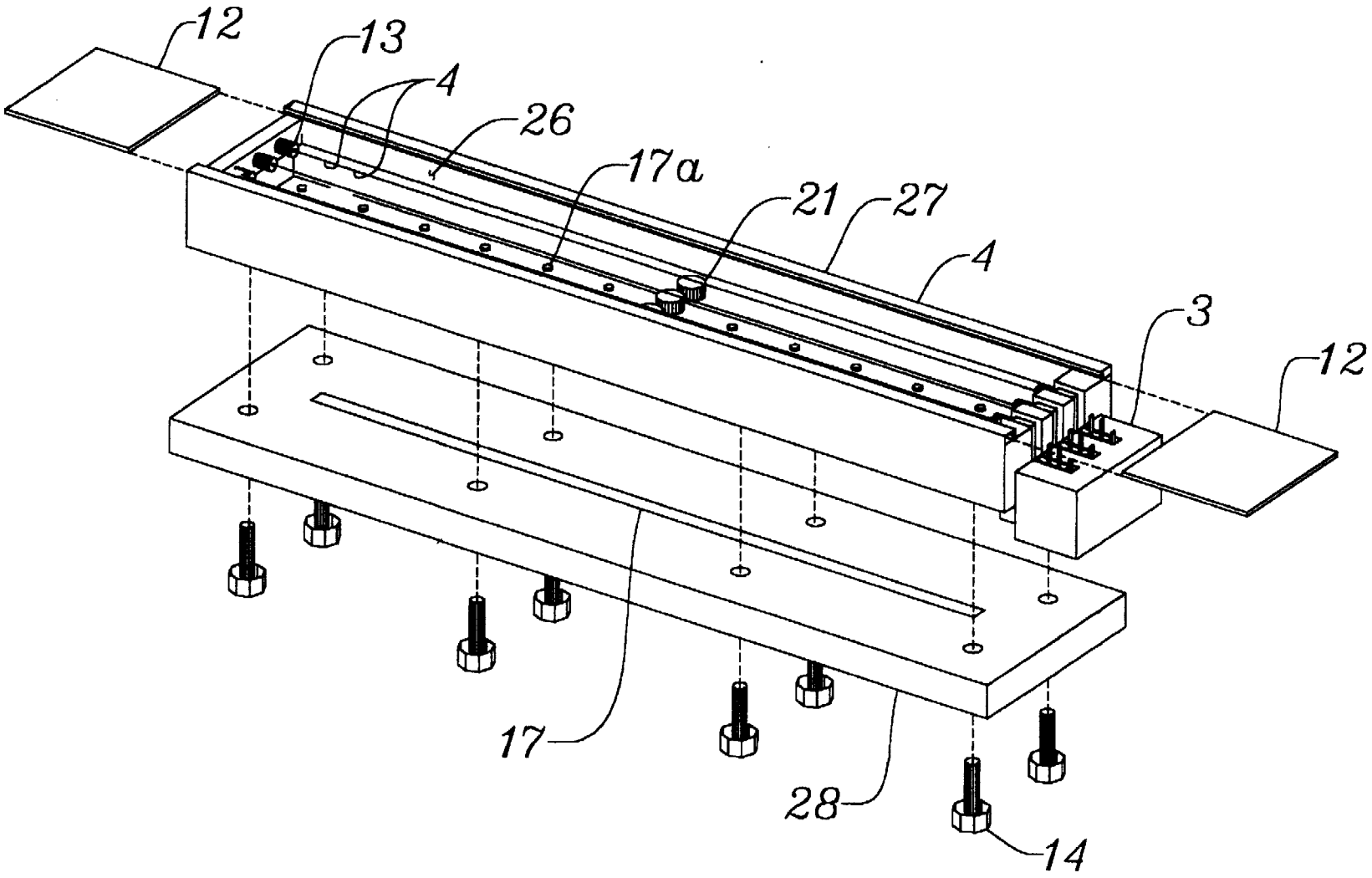
FIG. 5 is an exploded three dimensional perspective view of the ionizer channel frame illustrating the two piece construction of the ionizer frame.

The channel frame 2 is typically made of a high arc resistance material such as acrylic plastic. It has a "dug out" channel 26 in a block of acrylic inside of which the assemblies 3, 4, and 5 are mounted. The channel frame may be constructed of one block of material or, preferably, as is shown in FIG. 5, made out of two thick plates of acrylic, one of which, the front plate 27, has the channel 26 cut within it (i.e., the "dug out" section) along its entire length. This front plate 27 is attached to the back plate 28 as, for example, by means of threaded fasteners such as screws (typically plastic screws) 14 to form the channel frame 2. The back plate 28 has an air flow channel 17 machined throughout in the center as shown in FIG. 5. The air flow channel 17 is machined out, typically as a rectangular groove within the back plate 28. A plurality of branch conduits 17*a* extended upwardly from channel 17, through front plate 27, and open in a series of orifices within channel 26 that are preferably aligned in a single row beneath the central one of the ionizing wires 4. When assembled together with the plate 27, the groove in the back plate 28 forms a substantially enclosed channel 17 for air or other gas flow as shown in FIGS. 1 to 5. The front plate has the series of small apertures formed at the terminal ends of conduit ducts 17*a* at locations such that these holes form gas outlets from channel 17 into the ionizing region within front plate 27, as is illustrated in FIG. 5. A pipe fitting 18 is connected to the opening in the back plate 28 by means of providing a threaded hole of the appropriate size on back plate 28. This pipe fitting 18 connects to the air flow channel 17. The advantages of using two plates instead of one block of material for the construction of the ionizer frame 2 are as follows. Firstly, use of two plates 27 and 28 allows for the construction of ionizers with large widths. If one block of material is used, the air channel 17 must be formed by a drilling operation. Such an operation is difficult, if not impossible, when the block width is as large as 150 inches. Fiber and film processes often use web and film widths between 90–150 inches. This drilling operation becomes even more difficult when the ionizer frame material is as brittle as acrylic. Secondly, this two plate approach allows for easier machining for the creation of the channel in the front plate 27. A third advantage of the two plate approach is that extremely wide ionizers may be constructed in multiple sections formed by the front plates and back plates, such that the joints in the front plate 27 are at different sections than the joints of back plate 28. Thus the electric leakage paths, if any, occurring due to the joints, are increased substantially, thereby minimizing the risk of arcing through such joints.

Referring collectively to FIGS. 1 to 5, the front plate has two spaced apart, oppositely facing sliding grooves 29 near the top surface, at both ends of the plate, such that insulating material (typically acrylic) exposure shields 12 can be slid into and out of the plate. By sliding the exposure shields in, the width of the ionizing zone is reduced and vice versa. This is one important feature of this invention because it allows for the treatment of different web widths provided that the web widths are smaller than the maximum ionizing exposure width of the ionizer. The maximum ionizing exposure width of the ionizer is achieved when the exposure shields are pulled out to the maximum limit, such that the springs 7 are still shielded or covered by the shields 12. It should be noted that operation of any ionizer such that the ionizing exposure width is greater than the web or film width, will result in wasted electrical energy, since a disproportionately high current will be transferred to the counter potential roll that is not covered by the dielectric web or film. This will occur to a greater extent if the counter potential roll is not coated with a dielectric layer. Not only would energy be wasted, but the charge density or charge flux into the web or film would be significantly reduced, because a disproportionately high amount of the ionization streamers would be transported to the exposed part of the counter potential roll. Thus the effectiveness of corona treatment would be drastically reduced. Hence, the adjustable exposure shield mechanism, described above, allows variation of the ionizing exposure width to accommodate for the treatment of smaller width webs or films, without energy loss and without requiring ionizers with the same size ionizing exposure width as the webs or films.

Figure 2:
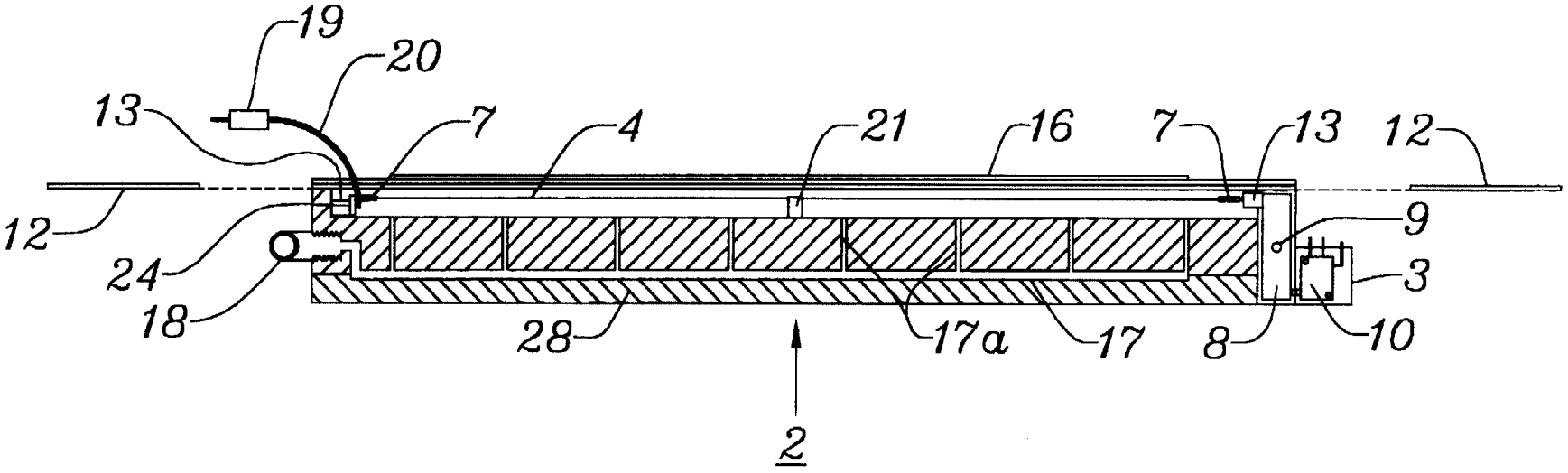
FIG. 2 is an elevational cross sectional view of the wire ionizer showing continuous wires strung across the face of the device.

Referring now to FIGS. 1 and 2, a netting or screen 16 made of a dielectric and non conductive material, such as polypropylene, is attached by means of fasteners such as preferably plastic threaded screws to the front plate 27. The netting 16 typically has a linear opening dimension of about one inch. Its purpose is to prevent wires 4 from snagging with the web or film, should one or more ionizing wires 4 happen to break. The netting opening size should be such that a broken ionizing wire is retained inside the ionizer frame 2. Typically a one inch opening netting is used. This is a secondary level safety feature that will come into play if the wire break detection switches 10, described below, fail or for some reason and do not cause shutdown of the process drive mechanism. Neither the safety netting nor screen are shown in the embodiment shown in FIGS. 3 and 4 in order to better illustrate the various components.

Referring now to FIGS. 1 through 4, wire ionizer 1 is attached to a plate or other mounting assembly (not shown), that is a part of the treatment process equipment, by means of using mounting bolts 22 and nuts 30 through mounting bolt holes 15 that are drilled through the back plate 28. A process mounting plate or other mounting assembly 36 must have similar size holes at the corresponding locations for mounting the ionizer.

Figure 11:
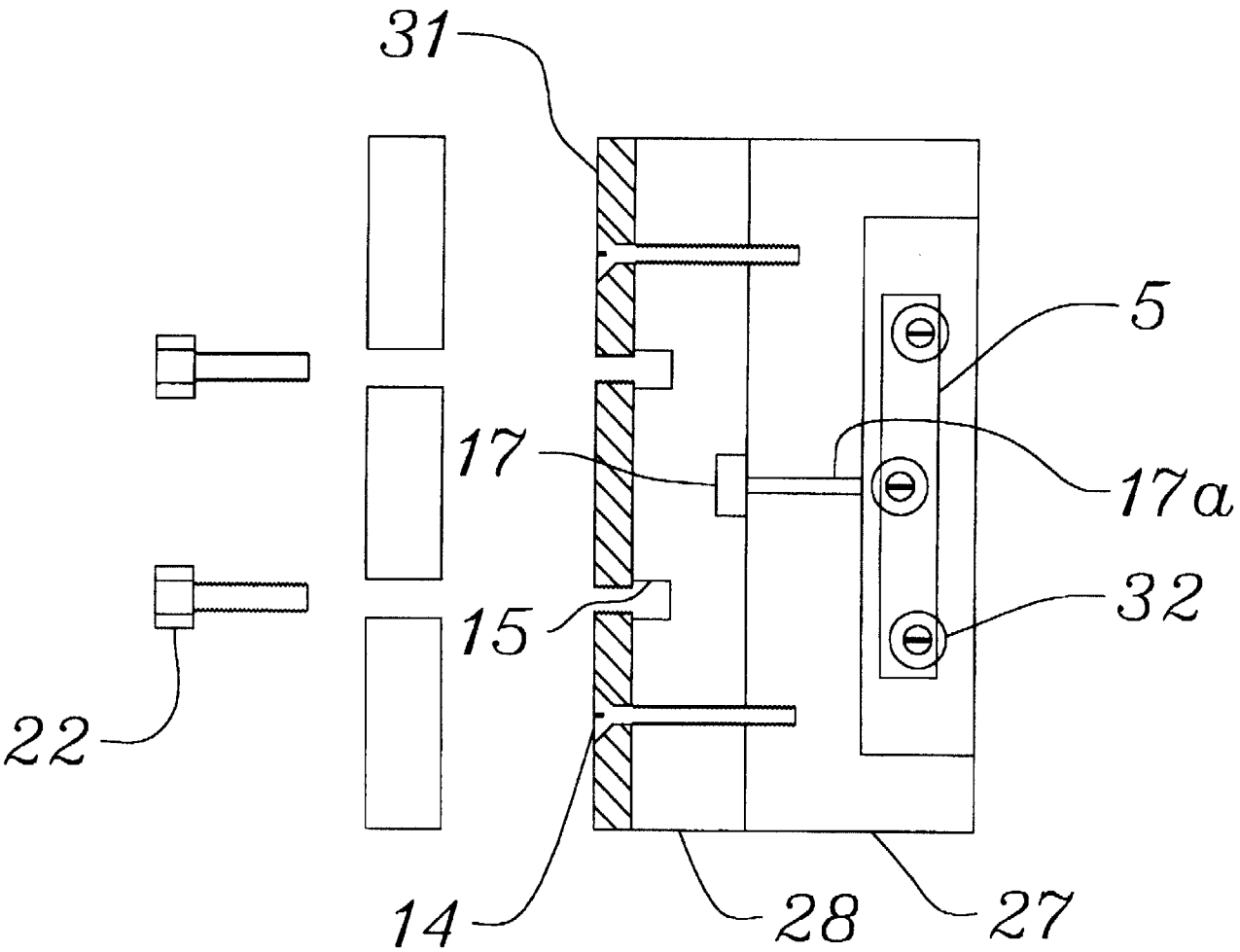
FIG. 11 is an end view of one embodiment of the ionizer illustrating the use of an optional metal mounting plate assembly.

Referring now to FIG. 11, in some cases, due to space constraints, it is not permissible to have back plate 28 of a larger height than front plate 27 of ionizer frame 2 assembly. In such a design the front and back plates are designed to be of equal height. Any mounting of back plate 28 to process mounting assembly 36 would mean that the back of plate 28 would have to be drilled and tapped for screwing onto the plate. This is not advisable however, for brittle materials, such as acrylic, because such drilled and tapped holes tend to develop star shaped fractures over time, especially if the screws are periodically removed for ionizer removal and reinstallation or if the ionizer 1 has substantial weight. In order to circumvent this from occurring, in such cases, a metal plate 31 may be attached by a high density of small screws 14 that are not subject to periodic removal. The metal plate 31 has the same or smaller height than the ionizer frame 2, and has a minimum thickness such that it is possible to drill and tap mounting holes in the metal plate. The back plate 28 of the ionizer frame 2 has corresponding holes that are larger than the mounting bolt holes on metal plate 31, so as to allow the ends of the mounting threaded bolts 22 to penetrate partially in these holes. This mounting arrangement thus effectively removes or reduces the screw thread stress on the plastic components of the ionizer frame 2.

Figure 8:
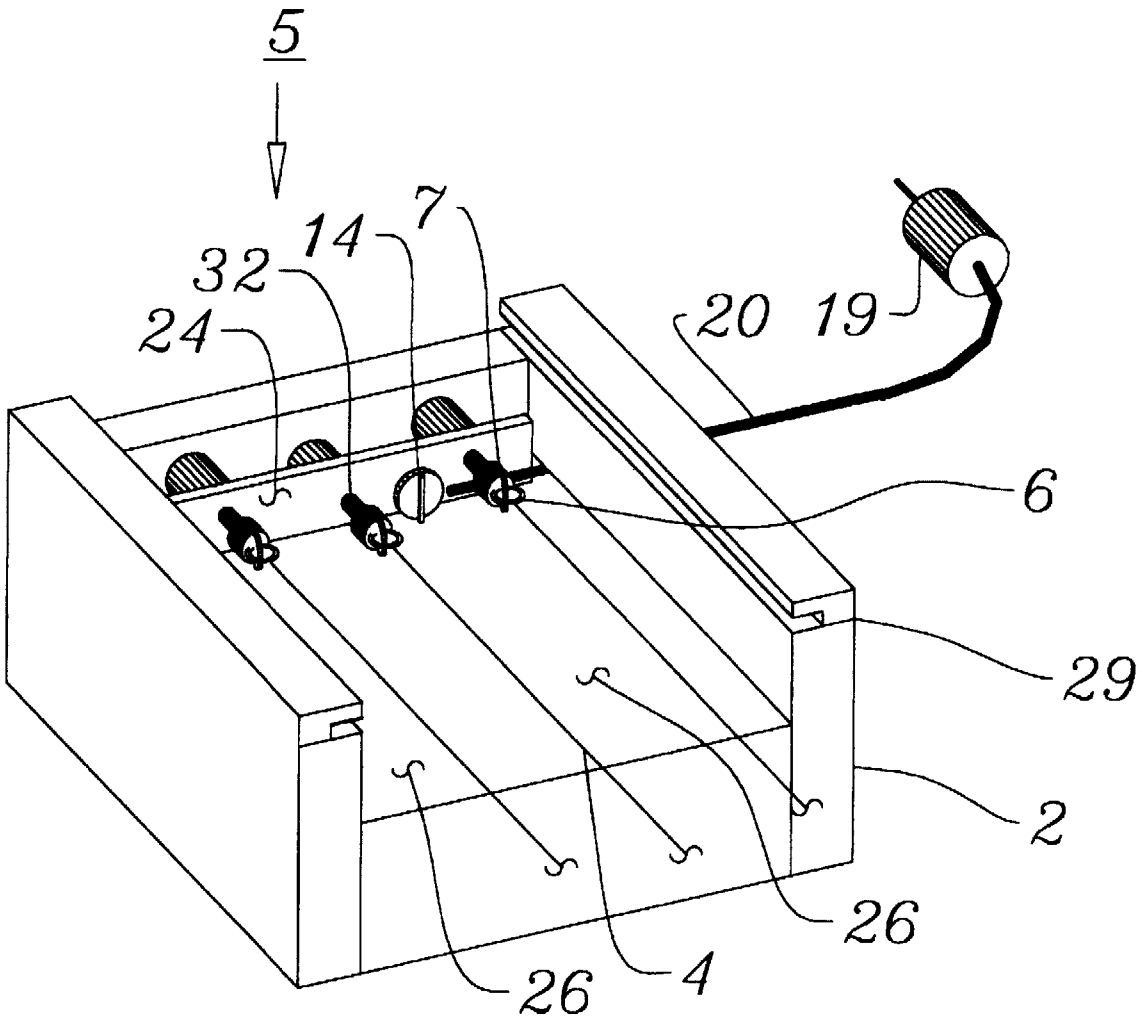
FIG. 8 is a partial perspective view showing construction of the high voltage bus and wire end connection for the continuous wire ionizer assembly in detail.
Figure 9:
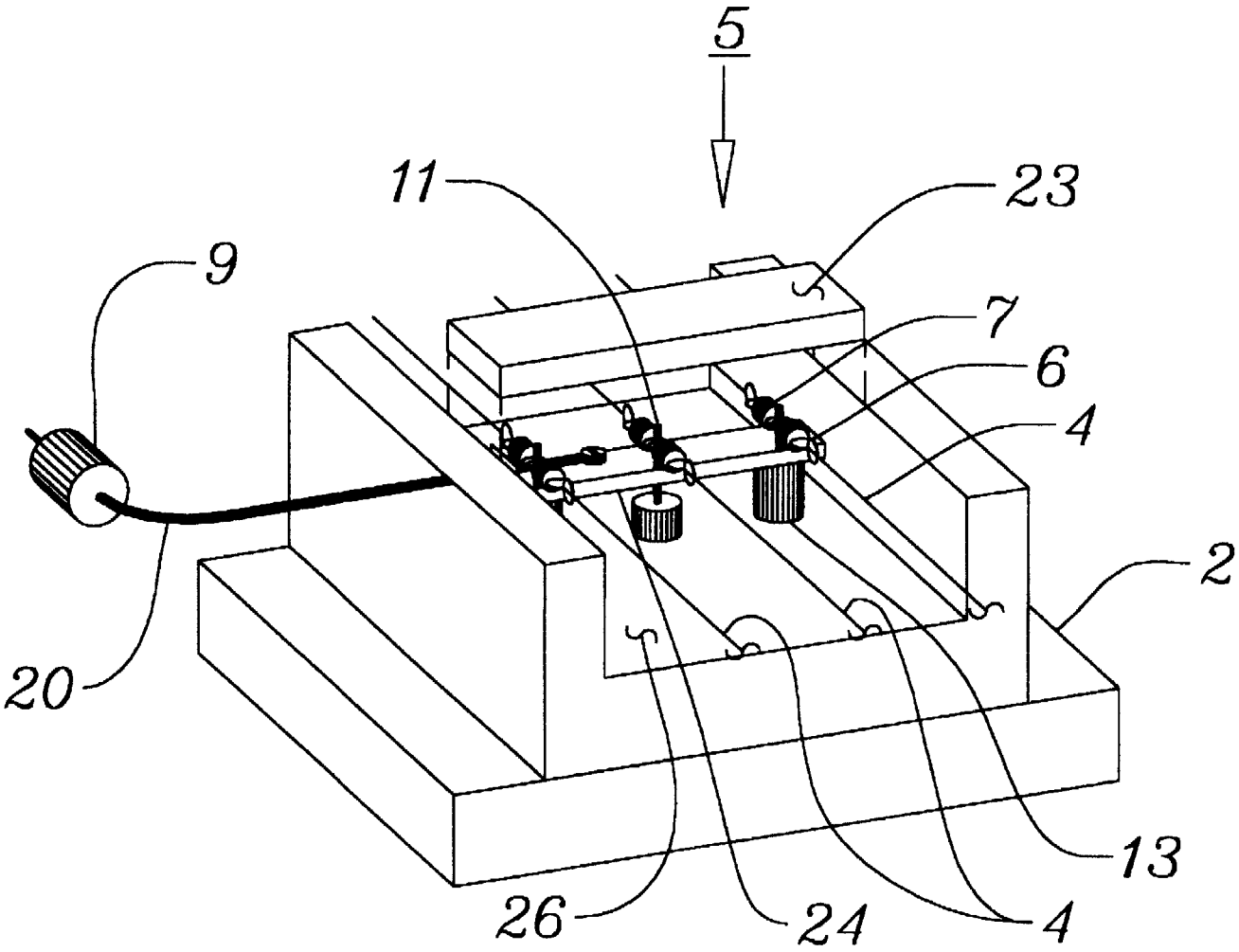
FIG. 9 is a partial perspective view showing construction of the high voltage bus and wire end connection for the split wire ionizer assembly in detail, with the center shield is exploded upwardly in order to better illustrate the assembly.

The ionizing wires 4 utilized for ionization are preferably tungsten wires with diameters between 0.2–1 min. Tungsten wires are preferred since they have high tensile strength even with a small diameter. If the width of the ionizer is about sixty inches or less, it is possible to use continuous ionizing wires 4 that span the width of ionizer 1 without concern regarding wire sagging breakage under tension. This case is illustrated in FIGS. 1, 2 and 8. Even in this case, some center support may be necessary. Ceramic supports 21 are used to prevent sagging of the wires, as shown in FIGS. 1 and 2. For higher widths split (i.e., two or more) wires may be used to cover this high width. This case is illustrated in FIGS. 3, 4 and 9. The wires 4 are attached to springs 7 by means of loops 6 on the end of the wires. The springs 7 are in turn attached, via metal screws 32 to a high voltage distribution bus or metal strip 24 at one end of the ionizer frame 2, in the embodiment shown in FIGS. 1 and 2 with continuous wires that span the width of the ionizer.

Referring now to the alternative embodiment shown by FIGS. 3 and 4, in the case of extremely wide ionizers, two or more (split) wires electrically coupled end-to-end in series and are used to span the width of the ionizer. Continuous electrical conduction occurs through bus 24, springs 7, and ionizing wires 4. In the case of two wire spanning the width, the distribution bus 24 is in the center of the ionizer frame as shown in FIGS. 3, 4 and 9. In this case the two split wires 4 share a common high voltage distribution bus 24. Hooks 11 are attached to the distribution bus 24 and the wire loops are attached to the hooks. Each hook supports each set of the split wires. Although the frame 2 material, typically acrylic, is a good insulator, it has been our experience that it is essential to further isolate the high voltage contact regions by means of a better insulator for longevity for continuous operation of the ionizer. Hence, the distribution bus 24 is mounted on double end threaded cylindrical ceramic or other high insulating material standoffs 13 via screws 14. The ceramic insulators are mounted via screws 14 on to the frame 2 material.

In the case of split wires spanning the width of the ionizer, it is essential that the distribution bus 24 and the width associated with the hooks 11 and springs 7, be shielded from the web or film and counter potential roll 35, in order to prevent high density streamers forming at this section. The high density streamers can occur at the distribution bus 24, hooks 11, and springs 7, due to their larger size (than the wires) and, thus, their closer proximity to the counter potential roller 35. Hence, it is necessary to provide a small acrylic or similar material shield 23 as part of the ionizer frame 2. This shield should be as wide as the combined distance between the farthest end of the springs 7 under tension. It is important to note that the width of the shield 23 (and thus the distance between the stretched out springs 7 on either side of the common high voltage distribution bus 24) be as small as possible, and preferably smaller that the spacing between the wires and the counter potential roll. If this width is less than the above-mentioned wire to counter potential roll spacing, then the section of web or film being treated that receives a lower density of corona treatment is negligible, since the ionizing field spreads outward from each wire.

Referring again to FIGS. 1 and 2, in the case of the continuous wires, the other end of the wires are attached to the tension levers 8 mounted adjacent to the switch block assembly 3. Referring to FIGS. 3 and 4, in the case of the two split wires, the other end of each of the split wires are attached via springs 7 to the ceramic insulators or standoffs 13. The ceramic standoffs 13 are in turn attached to the tension levers 8 mounted opposite the two switch block assemblies 3.

Figure 6:
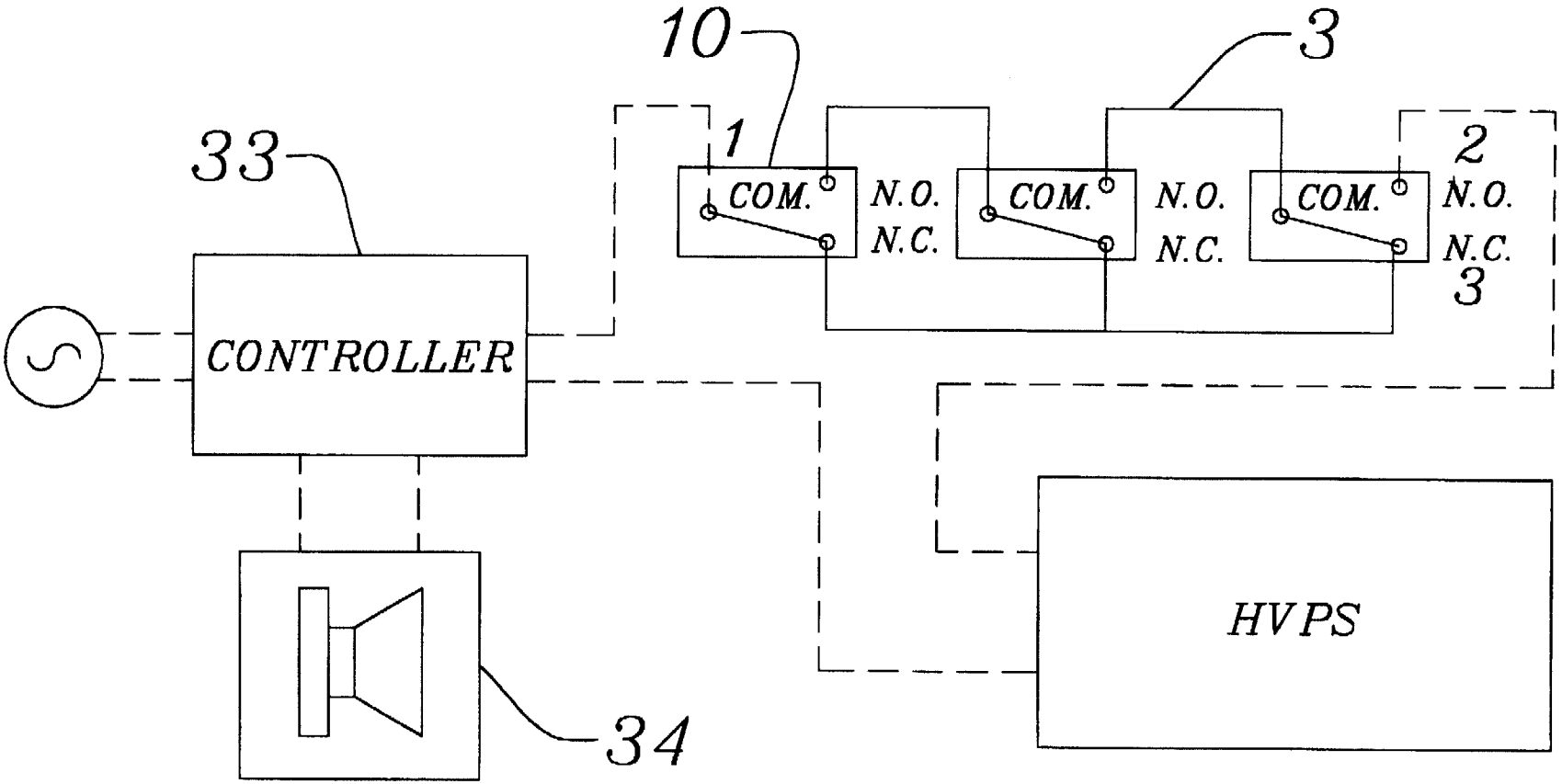
FIG. 6 is an electrical schematic wiring diagram for connecting the ionizer to the web or film process in a manner that safety is assured whenever an ionizing wire breaks.
Figure 7:
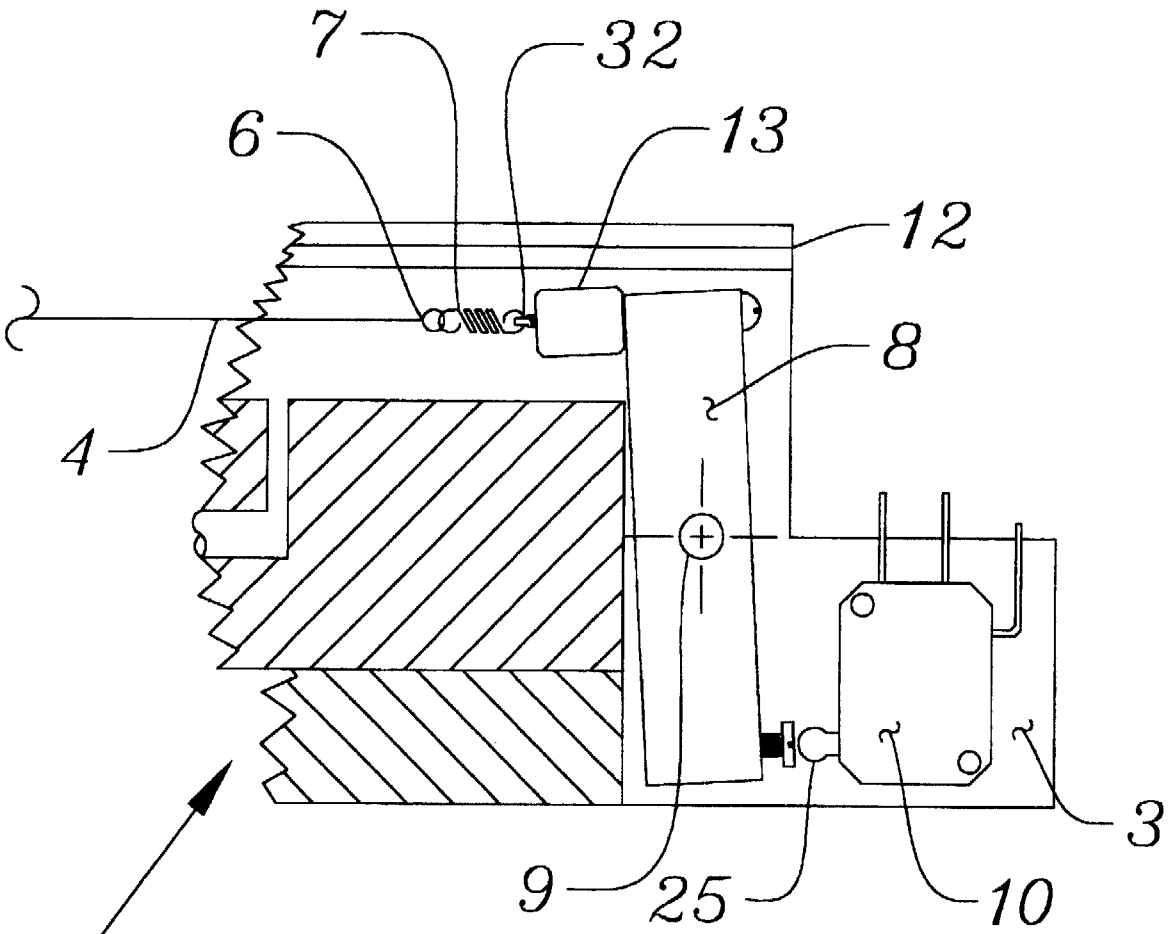
FIG. 7 is a detailed elevational view of the wire break detection lever and switch block assembly.

Referring now to FIG. 7, the switch block assembly 3 is a device for detection of wire breakage that can enable shutdown of the treatment process, if the process is connected to the switches 10 as indicated in FIG. 6. The switches 10 are conventional safety disconnect switches that have spring loaded levers 25 which protrude out of the body of the spring. Switches 10 are mounted on to the switch block assembly 3, which is in turn mounted on the ionizer frame 2. The levers of spring loaded switches 10 are aligned against tension levers 8 which are mounted on lever pin 9 which is mounted to ionizer frame 2. Tension levers 8 rotate freely about lever pin 9. A ceramic insulator 13 is mounted on the top end of each of tension levers 8 and a tension spring 7 is mounted on each of these ceramic insulators 13 using screws 32. One end of ionizing wires 4 are mounted on these springs 7 using loops 6. The tension between the wire suspension ends rotates the top end of the tension levers 8 inwards and the bottom end of the levers 8 pushes against levers 25 of the spring loaded switches 10, thereby turning on each of the switches. If a wire breaks, then the tension pulling one of the tension levers 8 is removed, thereby enabling a corresponding one of spring loaded levers 25 of switch 10 to push out against the corresponding one of the now freely rotating tension levers 8, thereby opening that switch 10 and the entire process circuit which is wired through that switch.

Figure 10:
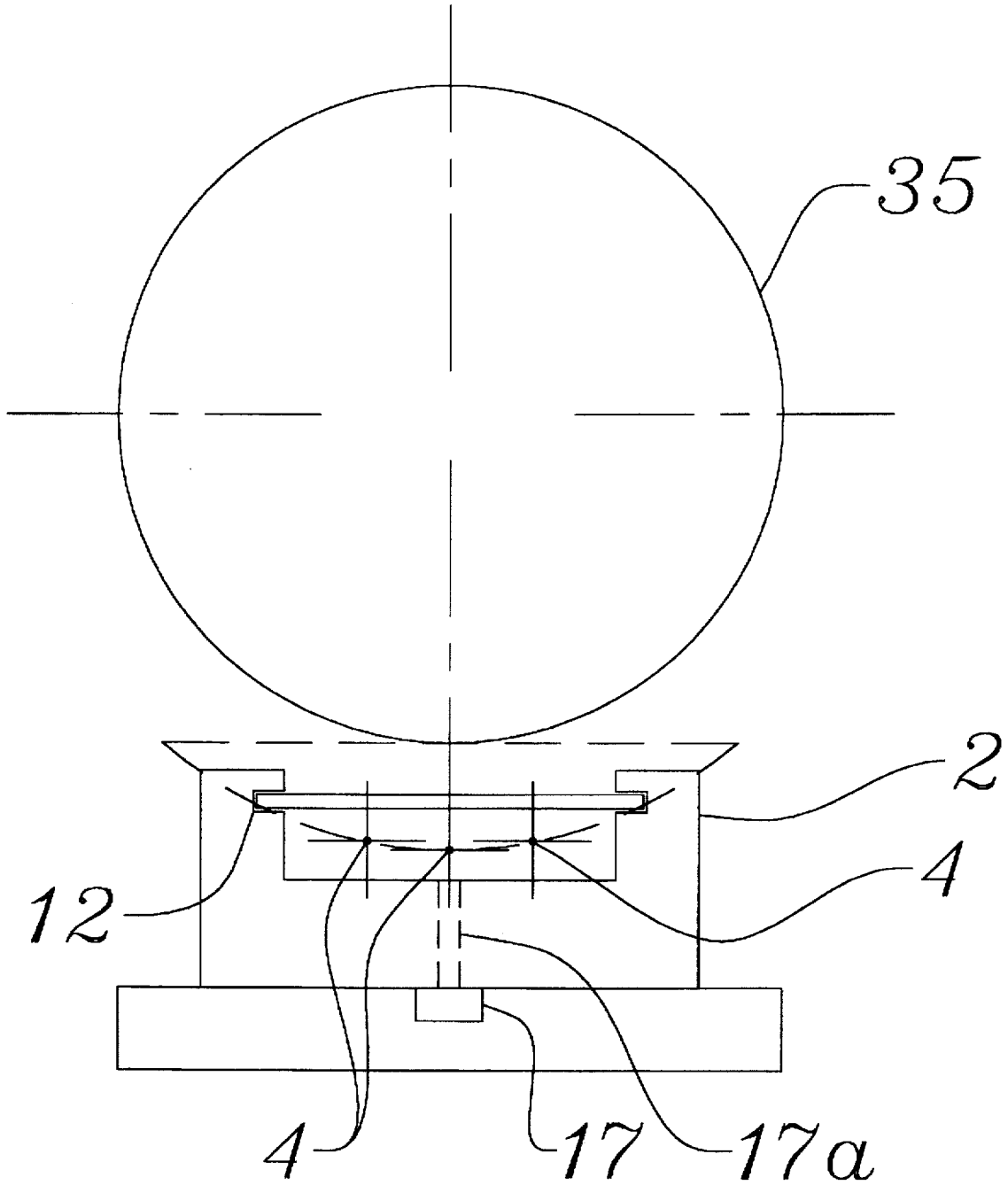
FIG. 10 is an end sectional view of the wire ionizer illustrating how the ionizing wires are positioned with respect to the process counter potential roller, so as to maintain equal field strengths for all wires.

Referring now to FIG. 10, although a single ionizing wire 4 may be used, typically three wires (continuous or split) are used in one ionizer. Ionizing wires 4 are positioned in a manner such that the distance between the distance of a radial line through the center of each ionizing wire and through the center of the counter potential roll 35 is the same for each wire. This is done by positioning center wire attachment spring 7 onto the distribution bus 24 and the corresponding center tension lever 8 deeper into the channel 26 in the ionizer frame 2. Thus an arc through the centers of the wires 4 is parallel to the circular center potential roll 35. This results in similar fields around each wire. This assures an equal ion flux through each wire.

Referring to again FIG. 6, when any one of switches 10 is opened, the power to a relay or other process controller 33 from a high voltage power source HVPS, which enables power to the process drive, is removed, thereby stopping the process according to the logic of the controller. Additionally, an alarm may be connected to the switch block 3 such that it turns on in the event of wire breakage.

Recent efforts such as represented by Dintner et al., U.S. Pat. No. 5,135,724 suggest an apparatus for increased surface modification by introduction of aerosols in the corona region such that these aerosols chemically react with the material that is being treated in the presence of the corona. In the case of forming permanently charged electrets, better results are obtained if the corona density is increased without reducing the uniformity of the corona flux. If conductive aerosols are introduced into the corona region, then the corona current will tend to follow the aerosol droplets and this can result in the formation of localized corona and a concomitant reduction in corona current flux uniformity. Hence, it is preferable to use high humidity air which can be produced by conventional methods such as evaporative heating and mixing with dry air. In order to ensure that no droplets enter the ionizing region, this humid air may be filtered by conventional air filters. This humid air is pumped through the air flow channel 17 and conduit ducts 17*a*, into the ionizing region of the channel frame 2. This allows for a uniform and intense corona treatment. For example, an increase in relative humidity from about 40% to 55% results in a doubling of corona current; increasing relative humidity from 40% to 65% will produce even higher corona current. Probably, relative humidity can be increased satisfactorily to 85% to 90%. Since water vapor is always uniformly distributed in the air, unlike the case for aerosol introduction, the uniformity of the corona current is maintained.

What is claimed is:

1. A wire corona charging apparatus, comprising:

an electrically conductive wire exhibiting a length;

a frame formed by a first plate of a non-electrically conducting material, said frame having a channel extending along one surface over a distance accommodating disposition of said wire within said channel;

means for resiliently supporting said wire within said channel while maintaining said wire under an axial tensile force and spaced-apart from interior surfaces of said channel, while applying an electrical current to said wire;

a shield of an electrically insulating material positioned in juxtaposition to said frame to slide along said distance and adjustably enclose part, but less than all, of said length within said channel;

means for converting a source of electrical energy into said electrical current; and switching means interposed within an electrical circuit controlling application of said electrical current to said supporting means, biased by said tensile force into a first mode of enabling conduction of said electrical energy to said converting means, for interrupting said application of said electrical current to said supporting means upon breakage of said wire.

2. The apparatus of claim 1, comprising:

an elongate member bearing an open slot extending along a major surface of said elongate member;

means for joining said elongate member to said frame with said major surface mating against a second surface of said frame to enclose said slot; and said frame being perforated by a plurality of ducts aligned with said slot to extend from said second surface to said channel to conduct fluid from said slot and into said channel.

3. The apparatus of claim 2, comprising said plurality of ducts being spaced-apart in said channel along said distance, with each of said ducts opening in a discrete orifice positioned within an array along a line disposed beneath said wire.

4. The apparatus of claim 1, comprising:

a plurality of additional said electrically conductive wires; and said supporting means holding said electrically conductive wire and said plurality of additional electrically conducting wires within said channel, under said tensile force, spaced-apart and parallel over said distance between said supporting means and said switching means, while applying the electrical current to said plurality of additional said electrically conductive wires.

5. The apparatus of claim 4, comprising said supporting means maintaining a first and least linear separation between said electrically conductive wire and said frame and maintaining greater least linear separations between said additional electrically conductive wires and said frame with values of said greater least linear separations increasing with displacement from said electrically conductive wire.

6. The apparatus of claim 4, with said switching means comprising:

a plurality of electrical switches coupled in electrical series within said path, said switches being separately biased by said tensile force applied to a different one of said electrically conducting wire and said plurality of additional electrically conducting wires into said first mode, and said switches being independently biased by corresponding lesser forces into a second mode of interrupting of said conduction upon breakage of an associated one of said electrically conducting wire and said plurality of additional electrically conducting wires.

7. The apparatus of claim 1, comprising:

said wire comprising a plurality of discrete and separate electrically conductive leads;

said supporting means comprising:

a first member attached to a first terminus portion of said frame and suspending a first end of a first one of said leads within said channel with said first one of said leads being spaced-apart from said frame; and a second member attached to a position on said frame intermediate to said first terminus portion and a second terminus portion of said frame separated from said first terminus by said distance, said second member electrically serially coupling a second end of said first lead to a first end of a second one of said leads while suspending said second end of said first lead and said first end of said second lead within said channel while spaced-apart from said frame.

8. A wire corona charging apparatus, comprising:

an electrically conductive wire exhibiting a length;

a frame formed by a first plate of a non-electrically conducting material, said frame having a channel extending along one surface over a distance accommodating disposition of said wire within said channel;

said frame bearing a pair of oppositely facing, spaced parallel grooves within and extending along said channel;

a shield of an electrically insulating material positioned within said grooves to slide along said distance and adjustably enclosing part, but less than all, of said length within said channel;

means for resiliently supporting said wire within said channel while maintaining said wire under an axial tensile force and maintaining said wire spaced-apart from interior surfaces of said channel, while applying an electrical current to said wire;

means for converting a source of electrical energy into said electrical current; and switching means interposed within an electrical circuit controlling application of said electrical current to said supporting means, biased by said tensile force into a first mode of enabling conduction of said electrical energy to said converting means and biased by a second and lesser force into a second mode of interrupting said conduction of said electrical energy to said converting means, for interrupting said application of said electrical current to said supporting means upon breakage of said wire.

9. The apparatus of claim 8, comprising said frame being perforated by a plurality of ducts extending between a second surface of said frame and said channel to conduct fluid into said channel, each of said ducts opening into a different discrete orifice positioned within an array along a line within said channel disposed beneath said wire.

10. A wire corona charging apparatus, comprising:

an electrically conductive wire exhibiting a length;

a frame formed by a first plate of a non-electrically conducting material, said frame having a channel extending along one surface over a distance accommodating disposition of said wire within said channel;

a shield of an electrically insulating material adjustably positioned upon said frame and enclosing part, but less than all, of said length within said channel;

means for resiliently supporting said wire within said channel while maintaining said wire under an axial tensile force and spaced-apart from interior surfaces of said channel, while applying an electrical current to said wire;

a plurality of additional said electrically conductive wires;

said supporting means holding said electrically conductive wire and said plurality of additional electrically conducting wires within said channel, under said tensile force, spaced-apart and parallel over said distance between said supporting means and said switching means;

means for converting a source of electrical energy into said electrical current; and switching means interposed within an electrical circuit controlling application of said electrical current to said supporting means, biased by said tensile force into a first mode of enabling conduction of said electrical energy to said converting means and biased by a second and lesser force into a second mode of interrupting said conduction of said electrical energy to said converting means, for interrupting said application of said electrical current to said supporting means upon breakage of said wire.

11. A corona wire charging apparatus, comprising:

an electrically conductive wire exhibiting a length;

a frame formed by a first plate of a non-electrically conducting material, said frame having a channel extending along one surface over a distance accommodating disposition of said wire within said channel;

said frame bearing a pair of oppositely facing, spaced-apart parallel grooves within and extending along said channel; and a shield of an electrically insulating material positioned within said grooves to slide along said distance while adjustably enclosing part, but less than all, of said length within said channel;

means for resiliently supporting said wire within said channel while maintaining, said wire under an axial tensile force and spaced-apart from interior surfaces of said channel, while applying an electrical current to said wire;

a plurality of additional said electrically conductive wires;

said supporting means holding said electrically conductive wire and said plurality of additional electrically conducting wires within said channel, under said tensile force, spaced-apart and parallel over said distance between said supporting means and said switching means;

a plurality of additional said electrically conductive wires;

said supporting means holding said electrically conductive wire and said plurality of additional electrically conducting wires within said channel, under said tensile force, spaced-apart and parallel over said distance between said supporting means and said switching means, while applying the electrical current to said plurality of additional said electrically conductive wires; means for converting a source of electrical energy into said electrical current; and switching means interposed within an electrical circuit controlling application of said electrical current to said supporting means, biased by said tensile force into a first mode of enabling conduction of said electrical energy to said converting means and biased by a second and lesser force into a second mode of interrupting said conduction of said electrical energy to said converting means, for interrupting said application of said electrical current to said supporting means upon breakage of said wire.

12. A wire corona charging apparatus comprising:

an electrically conductive wire exhibiting a length;

a frame formed by a first plate of a non-electrically conducting material, said frame having a channel extending along one surface over a distance accommodating disposition of said wire within said channel;

means for resiliently supporting said wire within said channel while maintaining said wire under an axial tensile force and spaced-apart from interior surfaces of said channel, while applying an electrical current to said wire;

a shield of an electrically insulating material positioned in juxtaposition to said frame to slide along said distance and adjustably enclose part, but less than all, of said length within said channel;

switching means interposed within an electrical circuit controlling application of said electrical current to said supporting means, biased by said tensile force into a first mode of enabling conduction of said electrical energy to said converting means, for interrupting said application of said electrical current to said supporting means upon breakage of said wire;

said supporting means being positioned at a first end of said channel and said switching means being positioned at a second end of said channel and separated by said distance from said supporting means; and said wire being strung under said tensile force, between said supporting means and said switching means.

13. A wire corona charging apparatus, comprising:

an electrically conductive wire exhibiting a length;

a frame formed by a first plate of a non-electrically conducting material, said frame having a channel extending along one surface over a distance accommodating disposition of said wire within said channel;

a pair of shields of an electrically insulating material adjustably positioned spaced-apart upon opposite ends of said frame and enclosing different parts, but not all, of said length within said channel;

means for resiliently supporting said wire within said channel while maintaining said wire under an axial tensile force and spaced-apart from interior surfaces of said channel, while applying an electrical current to said wire;

means for converting a source of electrical energy into said electrical current; and switching means interposed within an electrical circuit controlling application of said electrical current to said supporting means, biased by said tensile force into a first mode of enabling conduction of said electrical energy to said converting means and biased by a second and lesser force into a second mode of interrupting said conduction of said electrical energy to said converting means, for interrupting said application of said electrical current to said supporting means upon breakage of said wire.

14. A wire corona charging apparatus, comprising:

an electrically conductive wire exhibiting a length;

a frame formed by a first plate of a non-electrically conducting material, said frame having a channel extending along one surface over a distance accommodating disposition of said wire within said channel;

opposite ends of said frame bearing pairs of oppositely facing, spaced-apart grooves within and extending along said channel; and a pair of shields of electrically insulating material positioned within said grooves at different said opposite ends of said frame, to slide along said distance and enclose parts, but not all, of said length within said channel;

means for resiliently supporting said wire within said channel while maintaining said wire under an axial tensile force and spaced-apart from interior surfaces of said channel, while applying an electrical current to said wire;

means for converting a source of electrical energy into said electrical current; and switching means interposed within an electrical circuit controlling application of said electrical current to said supporting means, biased by said tensile force into a first mode of enabling conduction of said electrical energy to said converting means and biased by a second and lesser force into a second mode of interrupting said conduction of said electrical energy to said converting means, for interrupting said application of said electrical current to said supporting means upon breakage of said wire.

15. A wire corona charging apparatus, comprising:

an electrically conductive wire exhibiting a length;

a frame formed by a first plate of a non-electrically conducting material, said frame having a channel extending along one surface over a distance accommodating disposition of said wire within said channel;

said frame being perforated by a plurality of ducts extending between a second surface of said frame and said channel to conduct fluid into said channel, each of said ducts opening into a different discrete orifice positioned within an array along a line within said channel disposed beneath said wire;

means for resiliently supporting said wire within said channel while maintaining said wire under an axial tensile force and spaced-apart from interior surfaces of said channel, while applying an electrical current to said wire;

means for converting a source of electrical energy into said electrical current; and switching means interposed within an electrical circuit controlling application of said electrical current to said supporting means, biased by said tensile force into a first mode of enabling conduction of said electrical energy to said converting means and biased by a second and lesser force into a second mode of interrupting said conduction of said electrical energy to said converting means, for interrupting said application of said electrical current to said supporting means upon breakage of said wire;

means for introducing into said ducts for expulsion under pressure into said channel via each said orifice, a fluid consisting essentially of atmospheric air and water vapor.

16. The apparatus of claim 15, comprising:

a shield of an electrically insulating material adjustably positioned upon said frame and enclosing part, but less than all, of said length within said channel.

17. A wire corona charging apparatus, comprising:

an electrically conductive wire exhibiting a length;

a frame formed by a first plate of a non-electrically conducting material, said frame having a channel extending along one surface over a distance accommodating disposition of said wire within said channel;

said frame being perforated by a plurality of ducts extending between a second surface of said frame and said channel to conduct fluid into said channel, each of said ducts opening into a different discrete orifice positioned within an array along a line within said channel disposed beneath said wire;

means for resiliently supporting said wire within said channel while maintaining said wire under an axial tensile force and spaced-apart from interior surfaces of said channel, while applying an electrical current to said wire;

means for converting a source of electrical energy into said electrical current; and switching means interposed within an electrical circuit controlling application of said electrical current to said supporting means, biased by said tensile force into a first mode of enabling conduction of said electrical energy to said converting means and biased by a second and lesser force into a second mode of interrupting said conduction of said electrical energy to said converting means, for interrupting said application of said electrical current to said supporting means upon breakage of said wire;

means for introducing into said ducts for expulsion under pressure into said channel via each said orifice, a fluid consisting essentially of atmospheric air and water vapor, with said fluid exhibiting a relative humidity within a range extending from about forty percent to about fifty-five percent.

18. A wire corona charging apparatus, comprising:

an electrically conductive wire exhibiting a length;

a frame formed by a first plate of a non-electrically conducting material, said frame having a channel extending along one surface over a distance accommodating disposition of said wire within said channel;

said frame being perforated by a plurality of ducts extending between a second surface of said frame and said channel to conduct fluid into said channel, each of said ducts opening into a different discrete orifice positioned within an array along a line within said channel disposed beneath said wire;

means for resiliently supporting said wire within said channel while maintaining said wire under an axial tensile force and spaced-apart from interior surfaces of said channel, while applying an electrical current to said wire;

means for converting a source of electrical energy into said electrical current and switching means interposed within an electrical circuit controlling application of said electrical current to said supporting means, biased by said tensile force into a first mode of enabling conduction of said electrical energy to said converting means and biased by a second and lesser force into a second mode of interrupting said conduction of said electrical energy to said converting means, for interrupting said application of said electrical current to said supporting means upon breakage of said wire;

means for introducing into said ducts for expulsion under pressure into said channel via each said orifice, a fluid consisting essentially of atmospheric air and water vapor, with said fluid exhibiting a relative humidity within a range extending from about forty percent to about sixty-five percent.

19. A wire corona charging apparatus, comprising:

an electrically conductive wire exhibiting a length;

a frame formed by a first plate of a non-electrically conducting material, said frame having a channel extending along one surface over a distance accommodating disposition of said wire within said channel;

said frame being perforated by a plurality of ducts extending between a second surface of said frame and said channel to conduct fluid into said channel, each of said ducts opening into a different discrete orifice positioned within an array along a line within said channel disposed beneath said wire;

means for resiliently supporting said wire within said channel while maintaining said wire under an axial tensile force and spaced-apart from interior surfaces of said channel, while applying an electrical current to said wire;

means for converting a source of electrical energy into said electrical current; and switching means interposed within an electrical circuit controlling application of said electrical current to said supporting means, biased by said tensile force into a first mode of enabling conduction of said electrical energy to said converting means and biased by a second and lesser force into a second mode of interrupting said conduction of said electrical energy to said converting means, for interrupting said application of said electrical current to said supporting means upon breakage of said wire;

means for introducing into said ducts for expulsion under pressure into said channel via each said orifice, a fluid consisting essentially of atmospheric air and water vapor, with said fluid exhibiting a relative humidity of less than ninety percent.

20. A process for treating material, comprising:

maintaining an electrically conductive wire exhibiting a length suspended within a channel formed along one surface of a non-electrically conducting material over a distance accommodating disposition of said wire within said channel, while said wire is subject to an axially applied tensile force;

positioning a counter roller maintained at an electrical reference potential, spaced-apart from said wire with an axis of said counter roller aligned parallel to said length;

generating an electrical corona discharge emanating from said channel and toward said counter roller by applying an electrical potential different in value from said reference potential, to said length of said wire;

applying said tensile force to bias an electrical switch forming an electrical circuit controlling application of said electrical potential to said length of said wire into a first mode of enabling said application of said electrical potential to said length of wire;

applying a second and lesser force to bias said electrical switch into a second mode of interrupting said application of said electrical potential to said length of wire upon breakage of said wire;

expelling under pressure through a plurality of discrete ducts terminating in orifices spaced-apart along said channel and oriented toward said wire, a fluid comprised of atmospheric air and water vapor, with said fluid exhibiting a relative humidity within a range extending from about forty percent to about ninety percent; and continuously drawing material reacting to said corona discharge, between said wire and said counter roller with the material passing through said corona discharge.

21. A process for treating material, comprising:

maintaining an electrically conductive wire exhibiting a length suspended within a channel formed along one surface of a non-electrically conducting material over a distance accommodating disposition of said wire within said channel, while said wire is subject to an axially applied tensile force;

positioning a counter roller maintained at an electrical reference potential, spaced-apart from said wire with an axis of said counter roller aligned parallel to said length;

enclosing part, but not all, of said length of said channel, by adjusting positioning a shield of an electrically insulating material disposed between said wire and said counter roller, relative to one end of said channels;

generating an electrical corona discharge emanating from said channel and toward said counter roller by applying an electrical potential different in value from said reference potential, to said length of said wire;

applying said tensile force to bias an electrical switch forming an electrical circuit controlling application of said electrical potential to said length of said wire into a first mode of enabling said application of said electrical potential to said length of said wire;

applying a second and lesser force to bias said electrical switch into a second mode of interrupting said application of said electrical potential to said length of wire upon breakage of said wire; and continuously drawing material reacting to said corona discharge, between said wire and said counter roller with the material passing through said corona discharge.

22. A process for treating material, comprising:

maintaining an electrically conductive wire exhibiting a length suspended within a channel formed along one surface of a non-electrically conducting material over a distance accommodating disposition of said wire within said channel;

positioning a counter roller maintained at an electrical reference potential, spaced-apart from said wire with an axis of said counter roller aligned parallel to said length;

generating an electrical corona discharge emanating from said channel and toward said counter roller by applying an electrical potential different in value from said reference potential, to said length of said wire;

expelling under pressure through a plurality of discrete ducts terminating in orifices spaced-apart along said channel and oriented toward said wire, a fluid comprised of atmospheric air and water vapor, with said fluid exhibiting a relative humidity within a range extending from about forty percent to about ninety percent; and continuously drawing material reacting to said corona discharge, between said wire and said counter roller with the material passing through said corona discharge.

23. A wire corona charging apparatus, comprising:

an electrically conductive wire exhibiting a length;

a frame formed by a first plate of a non-electrically conducting material, said frame having a channel extending along one surface over a distance accommodating disposition of said wire within said channel;

means for resiliently supporting said wire within said channel while maintaining said wire spaced-apart from interior surfaces of said channel, while applying an electrical current to said wire;

said frame being performed by a plurality of ducts extending between a second surface of said frame and said channel to conduct fluid into said channel, each of said ducts opening into different discrete orifice positioned within an array along a line within said channel disposed beneath said wire; and mean for introducing into said ducts for expulsion under pressure into said channel via each said orifice, a fluid consisting essentially of atmospheric air and water vapor, with said fluid exhibiting a relative humidity within a range extending from about forty percent to about ninety percent.

24. The apparatus of claim 23, comprising a pair of shields of an electrically insulating material adjustably positioned spaced-apart upon opposite ends of said frame and enclosing different parts, but not all, of said length within said channel.

25. The apparatus for claim 23, comprising:

opposite ends of said frame bearing pairs of oppositely facing, spaced-apart grooves within and extending along said channel; and a pair of shields of electrically insulating material positioned within said grooves at different said opposite ends of said frame, to slide along said distance and enclose parts, but not all, of said length within said channel.

26. The apparatus of claim 23, comprising:

said wire comprising a plurality of discrete and separate electrically conductive leads coupled in electrical series;

said supporting means comprising:

a first member attached to a first terminus portion of said frame and suspending a first end of a first one of said leads within said channel with said first one of said leads being spaced-apart from said frame; and a second member attached to a position on said frame intermediate to said first terminus by said distance, said second member electrically serially coupling a second end of said first lead to a first end of a second one of said leads while suspending said second end of said first lead and said first end of said second lead within said channel while space-apart from said frame.

27. The apparatus of claim 23, comprising:

said supporting means maintaining said wire under an axial tensile force; and switching means interposed within an electrical circuit controlling application of said electrical current to said support means, biased by said tensile force into a first mode of enabling conduction of said electrical energy to said converting means and biased by a second and lesser force into a second mode of interrupting said conduction of said electrical energy to said converting means, for interrupting said application of said electrical current to said supporting means upon breakage of said wire.

* * * * *

UNITED STATES PATENT AND TRADEMARK OFFICE

CERTIFICATE OF CORRECTION

PATENT NO. : 5,627,376
DATED : May 6, 1997
INVENTOR(S) : Rajan A. Jaisinghani

It is certified that error appears in the above-indentified patent and that said Letters Patent is hereby corrected as shown below:

Drawings:

Delete Title page, and insert attached Title page,

Signed and Sealed this

Twenty-ninth Day of July, 1997

Bruce Lehman

*Attest:*

BRUCE LEHMAN

*Attesting Officer*

*Commissioner of Patents and Trademarks*

United States Patent [19]

Jaisinghani et al.

[11] Patent Number: 5,627,376

[45] Date of Patent: May 6, 1997

[54] WIRE CORONA CHARGING APPARATUS

[75] Inventors: Rajan A. Jaisinghani, Midlothian; Tim G. Christensen, Chester, both of Va.

[73] Assignee: Product Development Inc. Midlothian, VA

[21] Appl. No.: 525,163

[22] Filed: Sep. 8, 1995

[51] Int. Cl.[6] ..... H01T 19/04

[52] U.S. Cl. ..... 250/325; 250/324

[58] Field of Search ..... 250/324, 325, 250/326; 361/225

[56] References Cited

U.S. PATENT DOCUMENTS

| | | | |
|---|---|---|---|
| 3,562,585 | 2/1971 | Gourdine | 361/4 |
| 3,609,484 | 9/1971 | Sakamaki et al. | 250/326 |
| 3,619,242 | 11/1971 | Ogawa et al. . | |
| 3,980,929 | 9/1976 | Bresnick | 361/57 |
| 4,002,907 | 1/1977 | Kalwar . | |
| 4,131,691 | 12/1978 | Morley et al. . | |
| 4,215,682 | 8/1980 | Kubik et al. . | |
| 4,551,784 | 11/1985 | DiNatale et al. | 250/324 |
| 4,606,930 | 8/1986 | Ueno et al. . | |
| 4,714,658 | 12/1987 | Kadash et al. . | |
| 4,772,788 | 9/1988 | Tsutsui et al. . | |
| 4,836,901 | 6/1989 | Manabe et al. . | |
| 5,108,780 | 4/1992 | Pitt et al. . | |
| 5,110,620 | 5/1992 | Tani et al. . | |
| 5,112,690 | 5/1992 | Cohen et al. . | |
| 5,135,724 | 8/1992 | Dinter et al. . | |
| 5,175,666 | 12/1992 | Saito | 250/324 |
| 5,194,291 | 3/1993 | D'Aoust et al. . | |
| 5,236,536 | 8/1993 | Brehm et al. . | |
| 5,264,989 | 11/1993 | Bauer | 361/225 |
| 5,332,897 | 7/1994 | Stobbe et al. | 250/324 |

*Primary Examiner*—Bruce C. Anderson

*Attorney, Agent, or Firm*—Robert E. Bushnell, Esq.

[57] ABSTRACT

An improved wire corona charging apparatus and processes for treating webs and films, to improve surface wettability characteristics and other surface properties, and to create permanently charged electrets. Corona produced by wires results in more evenly distributed ion flux under a high level of control, than possible with commonly used bar chargers. Wire chargers are not used in applications that involve webs and films of large width, since at these widths wires can slacken and break, resulting in possible electric shorting that can be a safety hazard in most non-batch processes. The embodiments disclosed overcome these reliability and safety issues.

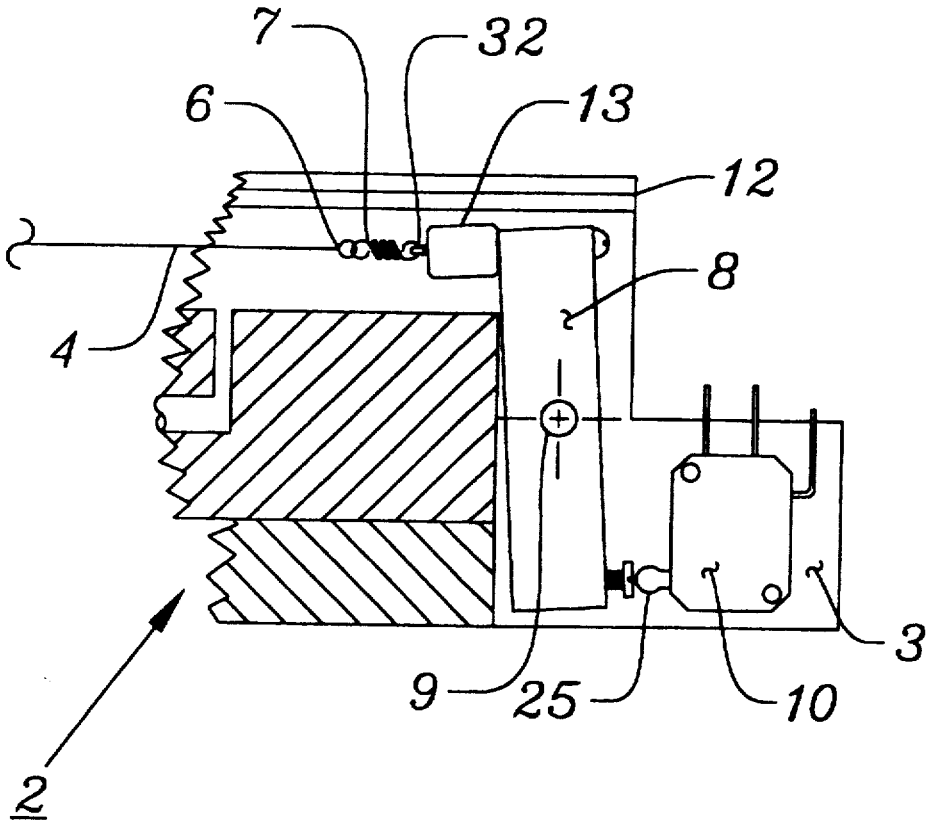

27 Claims, 11 Drawing Sheets